US009913529B2

(12) United States Patent
Tomm

(10) Patent No.: US 9,913,529 B2
(45) **Date of Patent: *Mar. 13, 2018**

(54) PUSH BROOM HEAD AND PUSH BROOM INCLUDING SAME

(71) Applicant: Erwin Tomm, Cleveland, OH (US)

(72) Inventor: Erwin Tomm, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/369,988

(22) Filed: Dec. 6, 2016

(65) Prior Publication Data

US 2017/0079417 A1 Mar. 23, 2017

Related U.S. Application Data

(63) Continuation of application No. 14/818,281, filed on Aug. 4, 2015, now Pat. No. 9,510,663.

(60) Provisional application No. 62/032,788, filed on Aug. 4, 2014.

(51) Int. Cl.

| | |
|---|---|
| ***A46B 5/00*** | (2006.01) |
| ***A46B 7/04*** | (2006.01) |
| ***A46B 9/02*** | (2006.01) |
| ***B25G 3/36*** | (2006.01) |

(52) U.S. Cl.

CPC ..... *A46B 9/02* (2013.01); *A46B 5/0095* (2013.01); *A46B 7/046* (2013.01); *B25G 3/36* (2013.01); *A46B 2200/302* (2013.01)

(58) Field of Classification Search

CPC ..... A46B 7/00; A46B 7/046; A46B 5/0095
USPC ..... D4/130, 132, 138; 15/171, 187, 188
See application file for complete search history.

(56) References Cited

U.S. PATENT DOCUMENTS

| | | | | | |
|---|---|---|---|---|---|
| D34,439 | S | * | 4/1901 | Stonebridge | 15/188 |
| 3,008,160 | A | * | 11/1961 | West | A47L 9/06 15/1.7 |
| D242,830 | S | * | 12/1976 | Scoggin, Jr. | D32/50 |
| D306,527 | S | * | 3/1990 | Kelly, III | D4/138 |
| 5,702,195 | A | * | 12/1997 | Rittenbaum | A46B 11/06 15/221 |
| 5,913,347 | A | * | 6/1999 | Wilen | A46B 3/06 15/115 |
| D415,616 | S | * | 10/1999 | Camp, Jr. | D4/199 |
| 6,085,379 | A | * | 7/2000 | Stafford | A46B 9/04 132/308 |
| D497,721 | S | * | 11/2004 | Angeletta | D28/7 |
| 7,798,755 | B2 | * | 9/2010 | Tomm | F16L 15/006 15/176.2 |
| 8,904,591 | B2 | * | 12/2014 | Vosbikian | A46B 5/0008 15/106 |

* cited by examiner

*Primary Examiner* — Randall Chin
(74) *Attorney, Agent, or Firm* — Fay Sharpe LLP

(57) ABSTRACT

A push broom head includes a body including an upper face, a lower face, a front face, a rear face, and left and right end faces. A plurality of sweeper bristles project outwardly from the lower face. A handle mounting block portion includes a socket adapted to receive an associated broom handle. The handle mounting block portion is located between left and right portions of the body. The body includes a plurality of open pockets defined in the upper face on both the left and right portions of the body. Each of the pockets opens through the upper face of the body and comprises a bottom wall. Each of the pockets defines a depth between the upper face of the body and the respective bottom wall.

16 Claims, 7 Drawing Sheets

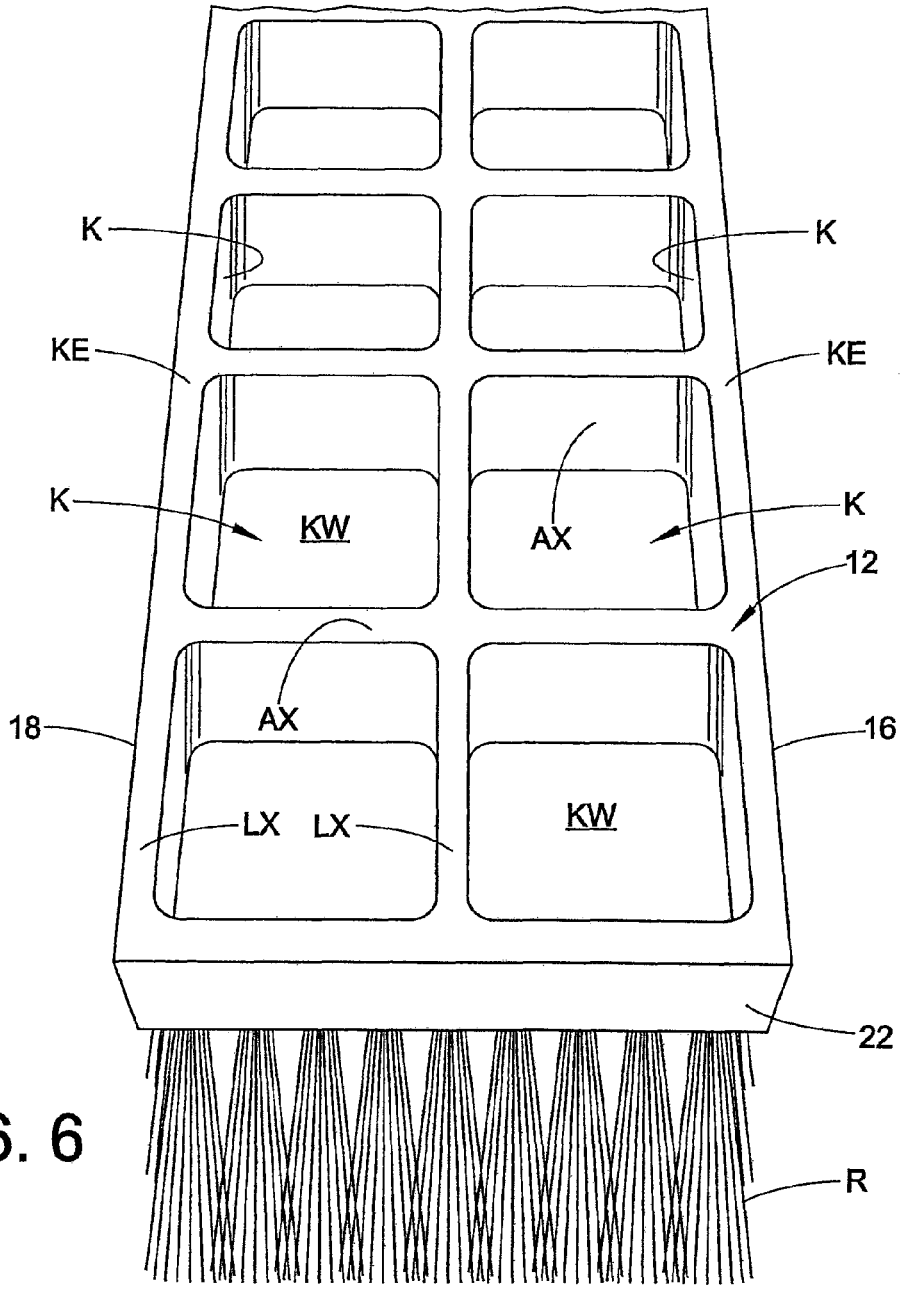
FI6. 6

PUSH BROOM HEAD AND PUSH BROOM INCLUDING SAME

CROSS-REFERENCE TO RELATED APPLICATION

This application is a continuation of U.S. application Ser. No. 14/818,281 filed Aug. 4, 2015 (Aug. 4, 2015), now assigned U.S. Pat. No. 9,510,663, which claims priority from and benefit of the filing date of U.S. provisional application Ser. No. 62/032,788 filed Aug. 4, 2014 (Aug. 4, 2014), and the entire disclosure of each of said applications is hereby expressly incorporated by reference into the present application.

BACKGROUND

Push brooms are well-known and in widespread use. Push brooms include a push broom head made from wood or a solid block of molded polymeric material that extends laterally and includes a multitude of broom bristles that are affixed to the lower surface thereof. The upper surface or upper side of the push broom head, on the side oriented away from the surface being swept, includes at least one threaded bore or female socket. An elongated broom handle includes a threaded male connector that is mated with the female socket of the push broom head. A user grasps the handle and moves the broom across a floor or other surface to be swept such that the bristles sweep the floor or other surface.

Known push brooms have been deemed unsuitable for use in certain institutional environment or other controlled locations such as prisons or mental health facilities because the wooden or polymeric head is sufficiently dense, heavy, and rigid that the push broom head can be used as a blunt weapon and/or because the wooden or polymeric head can be sharpened into a shank or other pointed weapon.

In light of the foregoing, a need has been identified for a new and improved push broom head and a push broom including same that is suitable for use in prisons and other institutional and controlled environments where increased safety is important.

SUMMARY OF THE PRESENT INVENTION

In accordance with a first aspect of the present development, a push broom head includes a body comprising an upper face, a lower face, a front face, a rear face, and left and right end faces. The push broom head further includes a plurality of sweeper bristles projecting outwardly relative to the lower face. A handle mounting block portion includes an internally threaded socket adapted to receive an associated broom handle. The handle mounting block portion is located between a left portion of the body and a right portion of the body. The body includes a plurality of open pockets defined in the upper face on both the left and right portions of the body. Each of the pockets opens through the upper face of the body and comprises a bottom wall. Each of the pockets defines a depth between the upper face of the body and the respective bottom wall.

In accordance with another aspect of the present development, a push broom head comprises an elongated body including an upper face and a lower face, wherein a plurality of bristles project outwardly relative to the lower face and wherein the upper face comprises a plurality of open pockets that define a waffle structure in the upper face, the push broom head body further comprising a handle mounting portion adapted to be connected to an associated broom handle.

BRIEF DESCRIPTION OF THE DRAWINGS

FIG. 6 is a partial isometric view of the right side of the push broom head of FIG. 1.

DETAILED DESCRIPTION OF PRESENT DEVELOPMENT

The present development relates to a push broom head and push broom including same as shown in FIGS. 1-6. The push broom PB includes a head D and an elongated handle H that is operably connected to the head D such that a user can grasp the handle H to move the push broom head D across the floor or other surface being swept in order to perform sweeping. The handle H includes an elongated outer portion HO defined from wood or another suitable material. The inner end of the handle H includes a tip T that is defined as a one-piece construction with the handle outer portion HO or that is defined from a molded polymeric or other structure that is affixed to the outer portion HO of the handle H. The tip T comprises an externally threaded male connector MC portion that is engaged with a mating internally threaded socket located in the push broom head D (described later) and also comprises a cylindrical outer surface TS that defines an outside diameter. One example of a suitable tip handle H and tip T are disclosed in commonly owned U.S. Pat. No. 7,798,755, and the entire disclosure of U.S. Pat. No. 7,798,755 is hereby expressly incorporated by reference into the present specification. In the present example, the base 12 of the connector 10 shown in U.S. Pat. No. 7,798,755 provides the present cylindrical outer surface TS and the threaded male portion 20 of the connector 10 shown in U.S. Pat. No. 7,798,755 provides the present threaded male connector portion MC, but other handle and tip structures are contemplated and fall within the scope of the present development.

Figure 1:
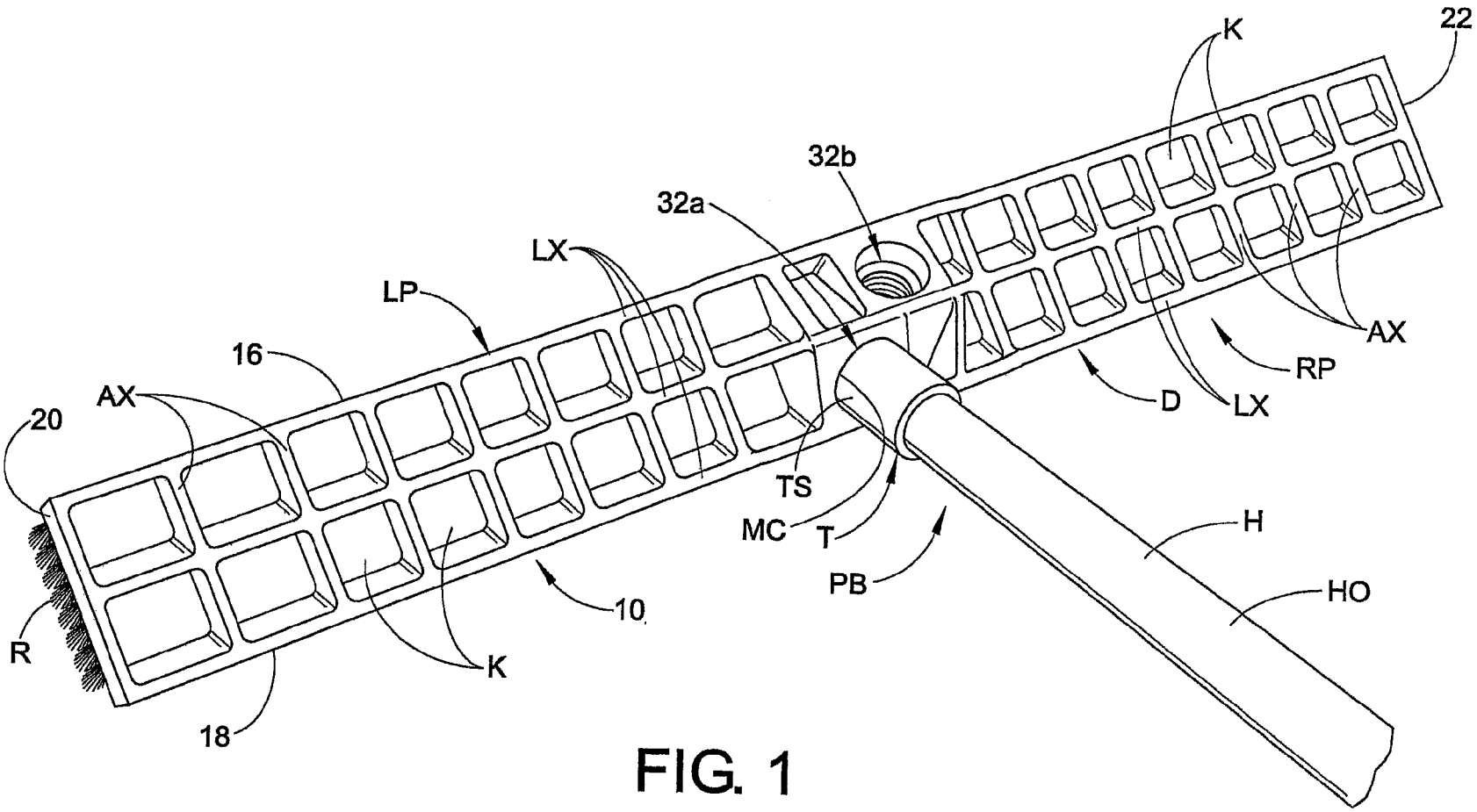
FIG. 1 is a rear isometric view of a push broom including a push broom head formed in accordance with the present development.
Figure 2:
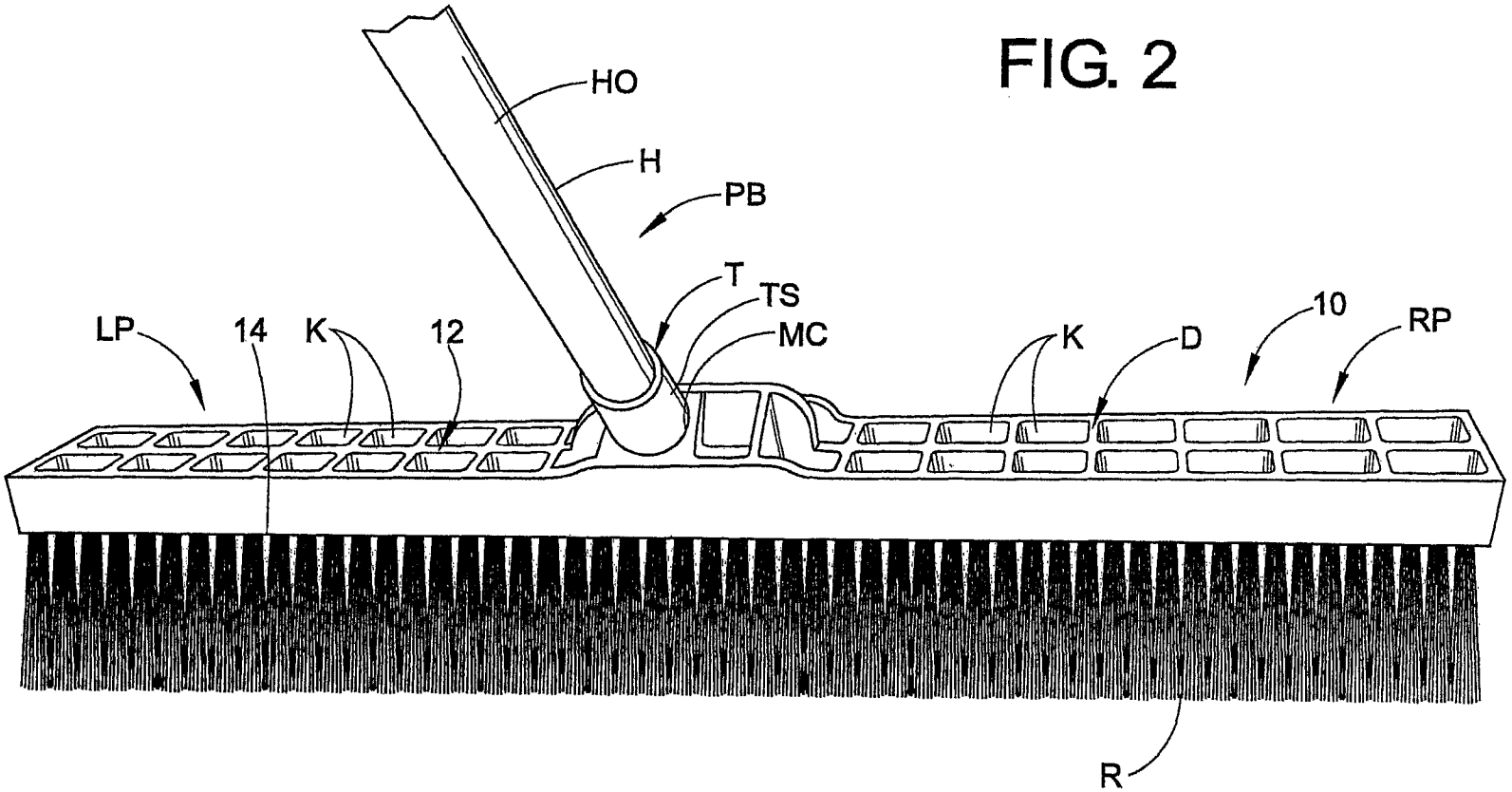
FIG. 2 is another rear isometric view of the push broom of FIG. 1.
Figure 3:
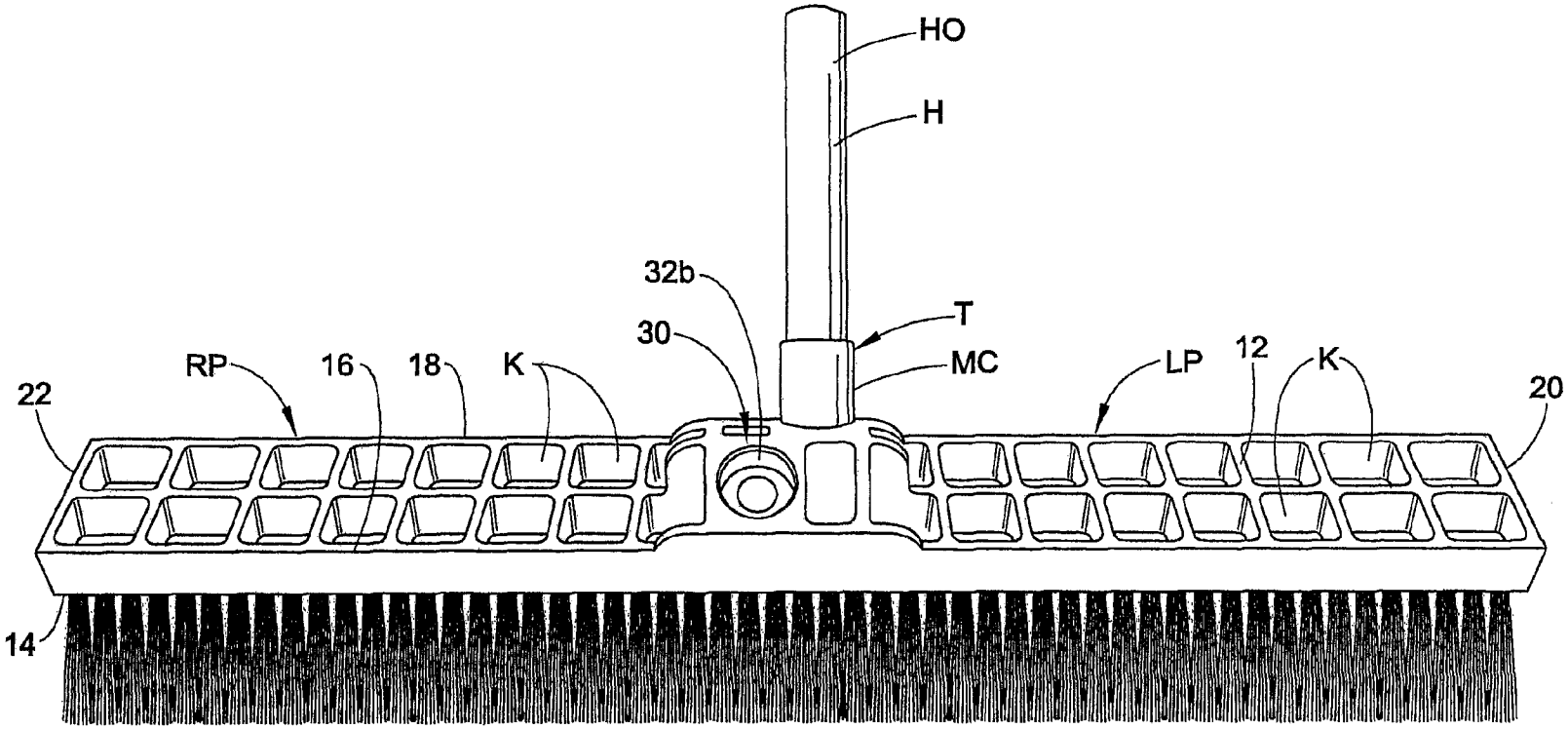
FIG. 3 is a front isometric view of the push broom of FIG. 1.
Figure 4:
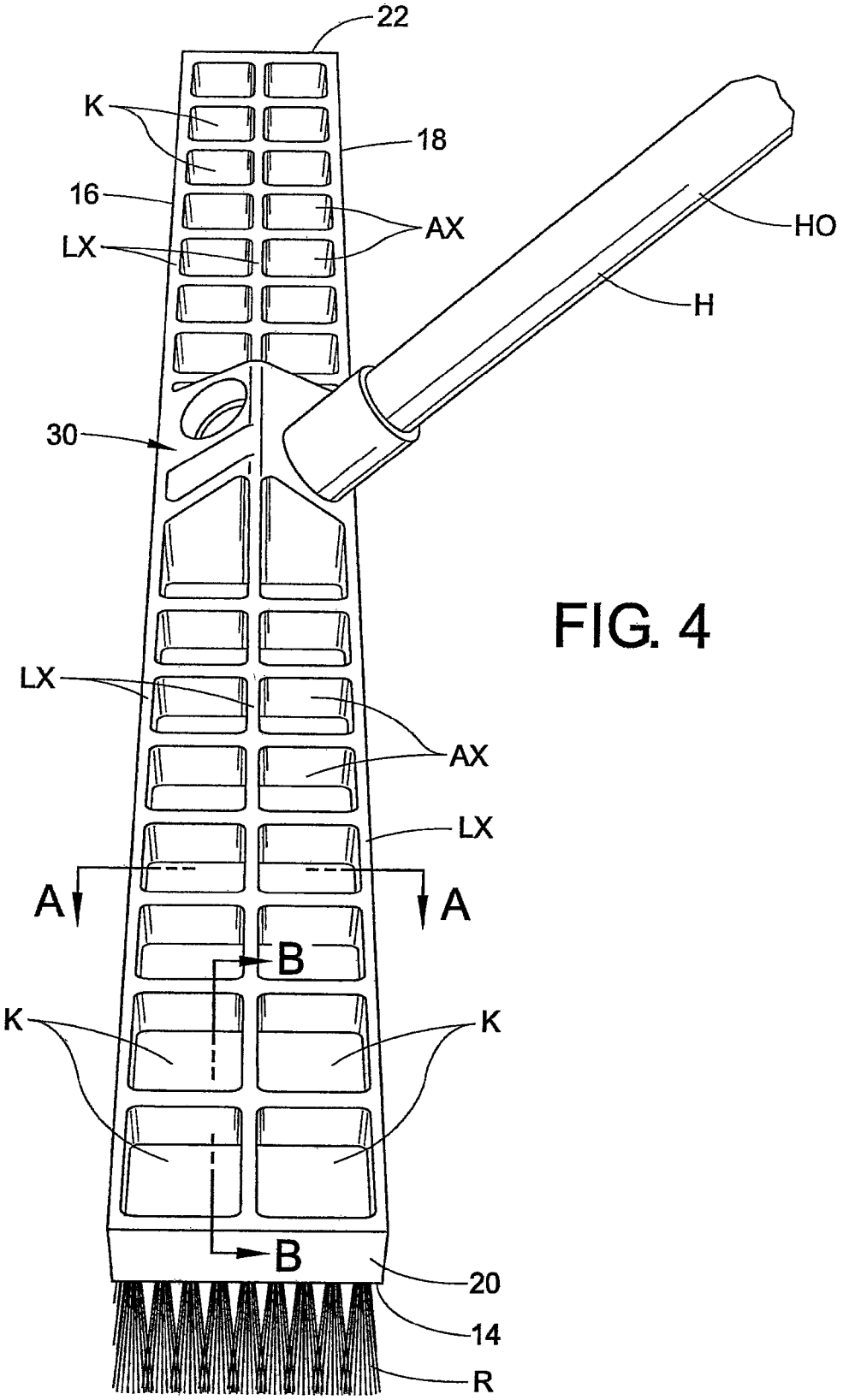
FIG. 4 is a left side isometric view of the push broom of FIG. 1.
Figure 4A:
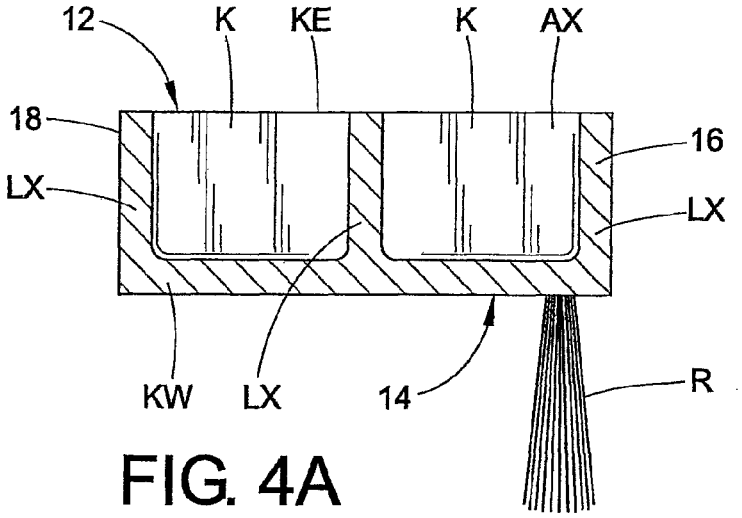
FIG. 4A is a section view taken at A-A of FIG. 4.
Figure 4B:
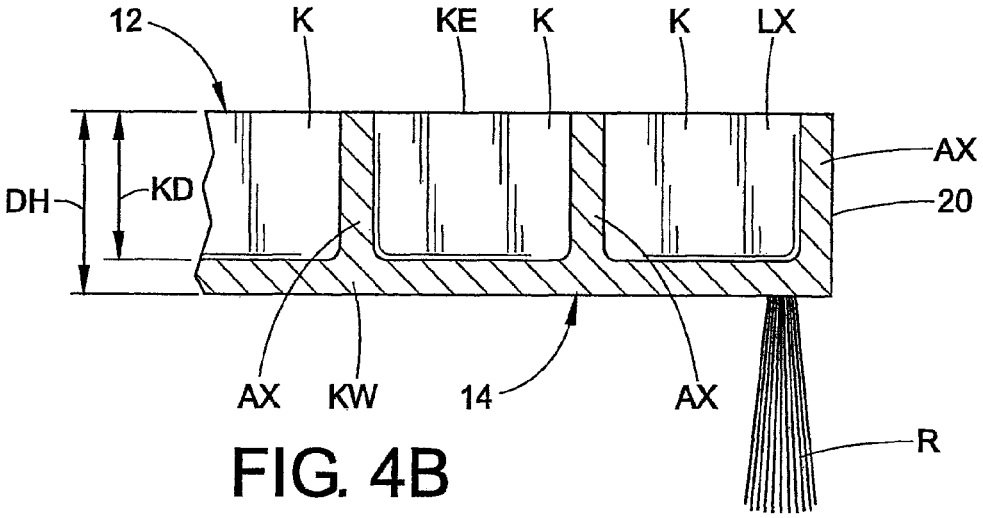
FIG. 4B is a section view taken at B-B of FIG. 4
Figure 5:
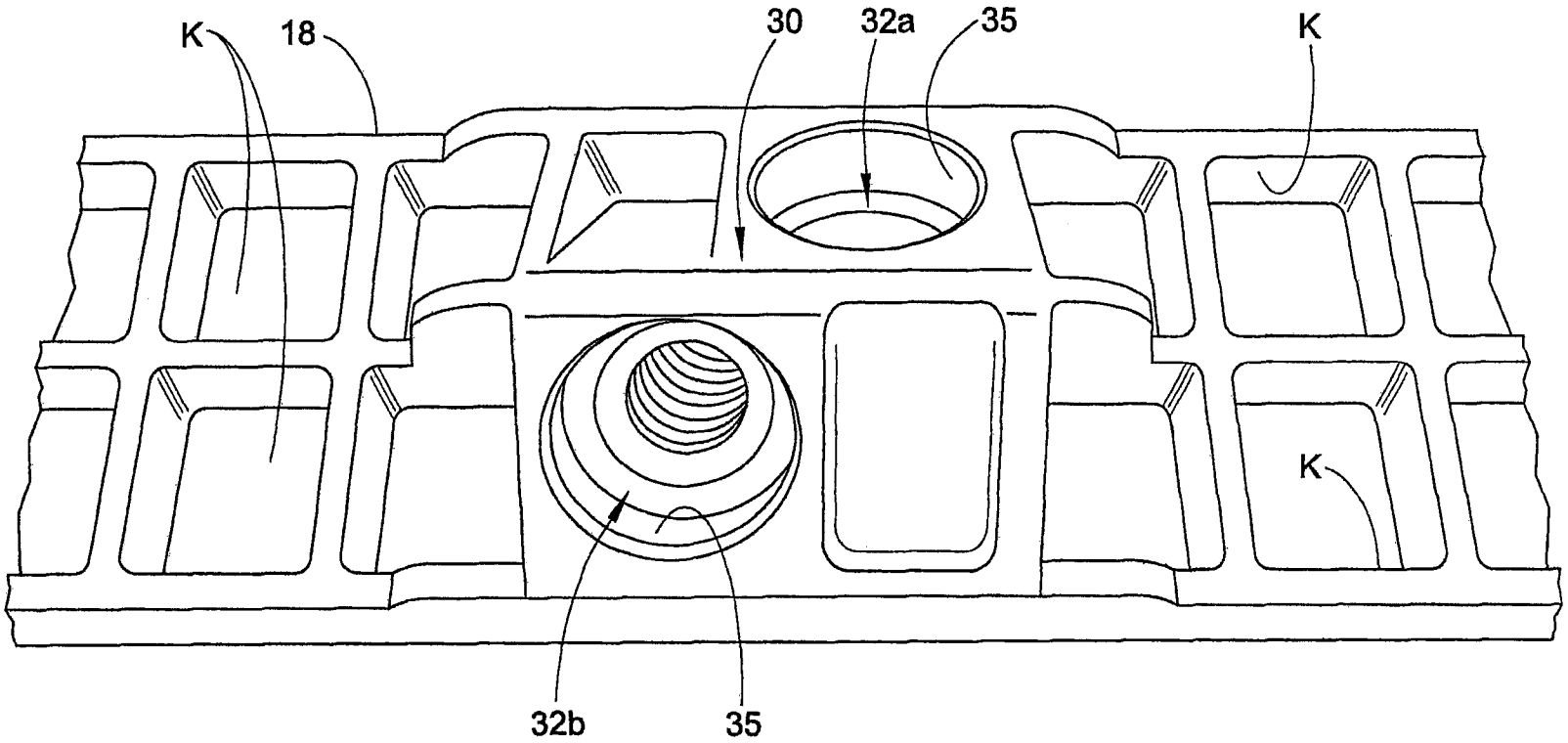
FIG. 5 is a partial isometric view of the handle mounting block portion of the push broom head of FIG. 1.

Referring now to all of FIGS. 1-6, the push broom head D comprises a laterally extending elongated body 10 that extends perpendicularly to the longitudinal axis of the handle H and that is defined as a one-piece polymeric structure, such as a one-piece injection molded or other polymeric structure. The body 10 includes an upper face 12, a lower face 14, a front face 16, a rear face 18, and opposite left (first) and right (second) end faces 20,22. In the illustrated embodiment, which is not intended to be limiting, the head D defines a rectangular shape. The upper and lower faces 12,14 are arranged parallel and spaced-apart from each other at a distance DH (see FIG. 4B) and are located about 1 inch apart in one example. The front and rear faces 16,18 are also arranged parallel and spaced-apart from each other and are located about 2.5 inches to about 3 inches apart in one example. The left and right end faces 20,22 are similarly arranged parallel and spaced-apart from each other and are located about 18 inches to about 24 inches apart from each other, depending upon the lateral width of the head D.

The lower face 14 of the head 10 is typically planar and the push broom head includes a plurality of polymeric, natural, and/or other type of sweeper bristles R affixed thereto by any known suitable means such as adhesive, polymeric welding, staples or other fasteners, or any other suitable convenient means such that the sweeper bristles project outwardly relative to the lower face 14. The front face 16, rear face 18, and left and right end faces 20,22 are also planar in the illustrated embodiment.

The body 10 of the push broom head D includes a handle mounting portion, a handle mounting block portion, or handle mounting block 30 that projects outwardly or upwardly from the upper surface 12 of the body 10 and that is located adjacent the upper face 12, generally at the midpoint between the left and right end surfaces 20,22. The handle mounting block 30 includes at least a first internally threaded handle mounting socket or bore 32*a* defined therein and adapted to receive and threadably mate with the externally threaded male connector portion MC of the tip T of the handle H. In one example, the first handle mounting socket 32*a* and the mating male connector portion MC of the handle tip T are defined with an ¾-5 ACME thread, but the present development is not limited to this particular thread. The central axis of the first handle mounting socket 32*a* is located in a plane that lies perpendicular to the front and rear faces 16,18 and that is oriented normal to the upper surface 12, but the central axis of the first handle mounting socket 32*a* is offset by about +32 degrees to about +37 degrees (e.g. +35 degrees) relative to a position where it would also lie normal to the upper surface 12 so that it opens toward the rear surface 18 of the head 10. In one preferred embodiment, the handle mounting block 30 comprises both first and second handle mounting sockets 32*a*,32*b* including the first handle mounting socket 32*a* and also a second identical handle mounting socket 32*b* oriented in the opposite direction as compared to the first socket 32*a*. The central axis of the second handle mounting socket 32*b* is located in a plane that lies perpendicular to the front and rear faces 16,18 and that is oriented normal to the upper surface 12, but the central axis of the second handle mounting socket 32*b* is offset by about −32 degrees to about −37 degrees (e.g. −35 degrees) relative to a position where it would also lie normal to the upper surface 12 so that it opens toward the front surface 16 of the push broom head 10 in an opposite direction as compared to the first socket 32*a*. The first and second handle mounting sockets 32*a*,32*b* are laterally offset from each other to ensure that they do not intersect each other. In this regard, the central axis of the first socket 32*a* is located closer to the left end face 20, and the central axis of the second socket 32*b* is located closer to the right end face 22. The presence of both the first and second handle sockets 32*a*,32*b* ensures that the push broom head PB is reversible, meaning that it can be used with either the front face 16 or the rear face 18 oriented forward (away from the user) which can extend the life of the bristles R and counteract a permanent set of the bristles R in a particular sweeping direction. Each of the first and second sockets includes a counterbore 35 (FIG. 5) at its outermost end, and the counterbore 35 is dimensioned to receive the cylindrical outer surface TS of the handle tip T with a tight, friction-fit that inhibits rotation of the handle tip T to minimize the tendency of the handle to become loose during use, i.e., the friction fit between the cylindrical outer surface TS and the mounting block 30 in the counterbore 35 inhibits loosening of the handle H.

For enhanced safety and to minimize the effectiveness of the push broom head D as a weapon, the push broom head is manufactured from a soft, low-density polymeric material such as polyurethane or any other suitable soft, low-density polymer. As such, the density and mass of the push broom head D are reduced relative to wooden or conventional polymeric push broom heads.

In addition to the use of a soft, low-density polymeric material to define the push-broom head D, the push broom head D is also structured to reduce its mass. In particular, the push broom head D comprises a plurality of open hollow voids, recesses, or pockets K defined in the upper face 12 thereof. In the embodiment illustrated in FIGS. 1-6, the push broom head comprises a left portion LP located between the left side face 20 and the handle mounting block 30, and comprises a right portion RP located between the right side face 22 and the handle mounting block. It is preferred that a plurality of pockets K be located on both the left portion LP and the right portion RP. As shown herein, the plurality of pockets K located on the left portion LP are arranged in a matrix or lattice like arrangement comprising at least two laterally extending rows of pockets K and a plurality of axially extending columns of pockets K, and the plurality of pockets K located on the right portion LP are all arranged in a matrix or lattice like arrangement comprising at least two laterally extending rows of pockets K and a plurality of axially extending columns of pockets K. In each case, the pockets K are defined by and between a plurality of ribs comprising a plurality of parallel, spaced-apart axially extending walls or ribs AX that extend axially between the front and rear faces 16,18, and a plurality of parallel, spaced-apart laterally extending walls or ribs LX that extend laterally between the left side face 20 and the handle mounting block for the left portion LP and that extend laterally between the right side face 22 and the handle mounting block 30 for the right portion RP. The front and rear faces 16,18 are provided by the outwardly facing sides of the outermost first and second laterally extending walls/ribs LX, and a third laterally extending wall/rib LX is centrally located between the outermost first and second laterally extending walls/ribs LX. In addition or as an alternative to the third, centrally located laterally extending wall/rib LX, more than one laterally extending wall or rib LX is located between the first and second laterally extending walls/ribs. In one example, the push broom head comprises four equally spaced laterally extending walls or ribs LX on each of the left and right portions LP,RP thereof, i.e., the first and second outermost walls LX defining the front and rear faces 16,18, and two additional walls LX located therebetween and arranged parallel therewith. The left and right faces 20,22 are provided by the outwardly facing sides of the left and right outermost axially extending ribs AX, respectively. The described structure of the push broom head D can be seen more particularly in FIGS. 4A and 4B which are respective section views taken at lines A-A and B-B of FIG. 4.

In the illustrated example, each void, recess, or pocket K is provided as an open-top and hollow square or rectangle region defined between first and second axially extending walls/ribs AX and first and second laterally extend walls/ribs LX. In the present example embodiment, each pocket K comprises an upper peripheral edge KE (FIG. 6) that defines a square or other rectangular shape where it opens through or intersects the upper face 12. The plurality of pockets K thus define the upper surface 12 of the push broom head D to have a waffle structure, i.e., a plurality of indentations K separated from each other by intersecting walls AX,LX. The open pockets K reduce the mass/weight of the push-broom head D as required for safety. The axially and laterally extending ribs AX,LW provide the required stiffness and rigidity to the push broom head D and are required to counteract the use of the soft, low-density polymer that would be too flexible in the absence of the axially and laterally extending ribs AX,LX. In an alternative embodiment, the pockets are circularly or otherwise shaped and open through the upper face with a circular or other shaped perimeter opening KE, and the walls/ribs AX,LX are arranged and shaped accordingly to provide the required stiffness and rigidity to the push broom head D. The walls/ribs AX,LX need not be parallel with each other or even linear in shape, and they can be irregularly shaped and sized without departing from the overall scope and intent of the present development. Although it is possible to have the pockets K open additionally or alternatively through the lower surface 14, this would limit the mounting locations for bristles R. Accordingly, in the illustrated embodiment, the pockets K are each open at an upper end KE adjacent the top surface 12 of the push broom head D closed at their inner/bottom end by a solid bottom wall KW (FIGS. 4A, 4B & 6), and the outer side of the bottom wall KW defines the bottom surface or lower surface 14 of the push broom head D.

Each pocket K defines a depth KD (FIG. 4B) that is at least 50% of the overall height DH of the push-broom head D measured between its upper and lower faces 12,14, (KD≥0.5*DH) and preferably the depth KD is greater than 67% (e.g., 75%) of the height DH (KD≥0.67*DH), but less than 90% of the height DH (KD≤0.90*DH). Stated another way, each pocket K preferably defines a depth KD comprising at least 50% of the height DH of the push-broom head D in the region where the pocket K is located, and most preferably at least 67% or more of the height DH of the push-broom head D in the region where the pocket K is located, such as 75%, but less than 90% of the height DH. The depth KD of each pocket K is a maximum distance measured inside each pocket K between the upper peripheral edge KE of the pocket K where it opens through or intersects the upper face 12 of the push-broom head D and its respective bottom wall KW.

The present development has been disclosed with reference to embodiments and examples disclosed herein, but it is not intended that the present development be limited only to the particular embodiments or examples disclosed herein. The following claims are to be construed as broadly as legally possible while preserving their validity.

The invention claimed is:

1. A push broom head comprising:

a body comprising an upper face, a lower face, a front face, a rear face, and left and right end faces;

a plurality of sweeper bristles projecting outwardly relative to the lower face;

a handle mounting block portion comprising an internally threaded socket adapted to receive an associated broom handle, wherein said handle mounting block portion is located between a left portion of said body and a' right portion of said body;

said body comprising a plurality of open pockets defined in said upper face on both said left and right portions of said body, wherein each of said pockets opens through said upper face of said body and comprises a bottom wall, and wherein each of said pockets defines a depth between said upper face of said body and said respective bottom wall, wherein said depth of said pockets is greater than 50% of the distance between said upper face and said lower face of said body;

each of said pockets defined between two laterally extending ribs that extend between said handle mounting block portion and one of said left and right end faces and two axially extending ribs that extend between said front and rear faces and that intersect the two laterally extending ribs.

2. The push broom head as set forth in claim 1, wherein said depth of said pockets is at least 67% of the distance between said upper face and said lower face of said body.

3. The push broom head as set forth in claim 1, wherein said body comprises a one-piece molded polymeric structure.

4. The push broom head as set forth in claim 1, wherein said plurality of pockets located on said left portion of said body are arranged in a first matrix of rows and columns, and said plurality of pockets located on said right portion of said body are arranged in a second matrix of rows and columns.

5. The push broom head as set forth in claim 4, wherein each of said pockets defines a rectangular opening in said upper face.

6. The push broom head as set forth in claim 4, wherein each of said pockets defines one of: (i) a circular opening in said upper face; (ii) a rectangular opening in said upper face.

7. The push broom head as set forth in claim 1, wherein said left and right portions of said body each comprise at least a third laterally extending rib.

8. The push broom head as set forth in claim 7, wherein said front face comprises an outwardly facing side of a first one of said laterally extending ribs, and said rear face comprises an outwardly facing side of a second one of said laterally extending ribs.

9. The push broom head as set forth in claim 8, wherein said third laterally extending rib of both said left and right portions of said body is centrally located between said first and second laterally extending ribs.

10. The push broom head as set forth in claim 8, wherein both said left and right portions of said body comprise a plurality of said axially extending ribs that extend between said first and second laterally extending ribs.

11. The push broom head as set forth in claim 1, further comprising an elongated push broom handle connected to said internally threaded socket of said handle mounting block portion.

12. The push broom head as set forth in claim 1, wherein each of said pockets defines one of: (i) a circular opening in said upper face; (ii) a rectangular opening in said upper face.

13. A push broom head comprising:

an elongated one-piece polymeric body including an upper face and a lower face, wherein a plurality of bristles project outwardly relative to the lower face and the upper face comprises a plurality of open pockets that define a waffle structure in said upper face;

said body further comprising a handle mounting portion adapted to be connected to an associated broom handle;

each of said pockets defining a depth relative to said upper face that is greater than 50% of the distance between said upper face and said lower face; and, each of said pockets defined between two laterally extending ribs that extend between said handle mounting portion and one of left and right end faces and two axially extending ribs that extend between front and rear faces.

14. The push broom head as set forth in claim 13, further comprising an elongated push broom handle connected to said handle mounting portion.

15. The push broom head as set forth in claim 13, wherein each of said pockets defines one of: (i) a circular opening in said upper face; (ii) a rectangular opening in said upper face.

16. A push broom head comprising:

a one-piece polymeric body comprising an upper face and a lower face;

a plurality of sweeper bristles projecting outwardly relative to the lower face;

said one-piece body further comprising a handle mounting block portion comprising an internally threaded socket adapted to receive an associated broom handle, wherein said handle mounting block portion is located between a left portion of said body and a right portion of said body;

said body comprising a plurality of open pockets defined in both said left portion of said body and said right portion of said body, wherein each of said pockets opens through said upper face of said body, and wherein said pockets are separated from each other by and defined between a plurality of intersecting laterally extending and axially extending walls such that said pockets defined in both said left portion of said body and said right portion of said body are arranged in rows and columns, each of said pockets defining a depth greater than 50% of the distance between said upper face and said lower face of said body.

* * * * *